US007491053B2

(12) United States Patent
Ishler

(10) Patent No.: US 7,491,053 B2
(45) Date of Patent: Feb. 17, 2009

(54) TAMPERHEAD FOR USE IN PRODUCTION OF MOLDED PRODUCTS

(75) Inventor: Vincent Ishler, Mercersburg, PA (US)

(73) Assignee: Rampf Molds Industries, Inc., Hagerstown, MD (US)

( * ) Notice: Subject to any disclaimer, the term of this patent is extended or adjusted under 35 U.S.C. 154(b) by 422 days.

(21) Appl. No.: 11/451,507

(22) Filed: Jun. 13, 2006

(65) Prior Publication Data

US 2006/0286195 A1 Dec. 21, 2006

Related U.S. Application Data

(60) Provisional application No. 60/690,835, filed on Jun. 16, 2005.

(51) Int. Cl.
*B28B 7/34* (2006.01)

(52) U.S. Cl. ..... 425/255; 425/421; 425/431; 425/456; 249/120

(58) Field of Classification Search ..... 425/253–255, 425/431–432, 456, 346, 349, 354; 249/199, 249/120, 117, 122, 139
See application file for complete search history.

(56) References Cited

U.S. PATENT DOCUMENTS

| | | | | |
|---|---|---|---|---|
| 805,914 | A | 11/1905 | Horr | |
| 813,592 | A | 2/1906 | Schou | |
| 3,940,229 | A | 2/1976 | Hutton | |
| 4,407,766 | A | 10/1983 | Haardt et al. | |
| 4,545,754 | A | 10/1985 | Scheidt | |
| 5,078,940 | A | 1/1992 | Sayles | |
| 5,217,630 | A | 6/1993 | Sayles | |
| 5,533,885 | A | 7/1996 | Schlusselbauer | |
| 5,879,603 | A | 3/1999 | Sievert | |
| 6,113,379 | A | 9/2000 | LaCroix et al. | |
| 6,138,983 | A | 10/2000 | Sievert | |
| 6,209,848 | B1 | 4/2001 | Bolles et al. | |
| 6,224,815 | B1 | 5/2001 | LaCroix et al. | |
| 6,280,566 | B1 | 8/2001 | Naito et al. | |
| 6,464,199 | B1 | 10/2002 | Johnson | |
| 7,291,306 | B2 * | 11/2007 | Ishler | 425/419 |
| 2003/0164574 | A1 | 9/2003 | Hammer et al. | |
| 2005/0116389 | A1 | 6/2005 | Hammer et al. | |

FOREIGN PATENT DOCUMENTS

| | | | |
|---|---|---|---|
| JP | 2001191314 | A | 7/2001 |

* cited by examiner

*Primary Examiner*—Yogendra Gupta
*Assistant Examiner*—Thu Khanh T Nguyen
(74) *Attorney, Agent, or Firm*—Howrey LLP

(57) ABSTRACT

The present invention relates to a tamperhead structure including metal and/or non-metal components. The structure may include a top plate and a bottom plate separated by a plurality of spacers. The head structure may also include a plurality of plungers attached to the bottom plate and a stripper shoe attached to each of the plurality of plungers. Each of the components of the tamperhead structure may be fabricated from metal material, non-metal material or a combination of both metal and non-metal materials.

14 Claims, 3 Drawing Sheets

TAMPERHEAD FOR USE IN PRODUCTION OF MOLDED PRODUCTS

RELATED U.S. APPLICATIONS

This application claims the benefit of U.S. provisional application No. 60/690,835 filed Jun. 16, 2005 and entitled "Apparatus and Method for a Composite Head Structure," incorporated herein by reference.

FIELD OF THE INVENTION

The invention generally relates to concrete-based product making machinery. More particularly, the invention relates to a tamperhead for use in machinery for producing molded concrete-based products.

BACKGROUND OF THE INVENTION

Concrete masonry units are typically produced using a production machine and a mold assembly. Generally, the mold assembly includes a mold having mold cavities and a tamperhead. The production machinery may drive the tamperhead into the mold to strip formed and compacted concrete products from the mold cavities.

The tamperhead is usually composed of several sub-components which may include an upper head structure, a plunger and a stripper shoe. Multiple sets of stripper shoes and plungers are connected to a single head structure and used to strip multiple masonry units from one or more molds or a set of concrete mold cavities. The plungers are commonly fabricated in structural shapes, depending on the shape and type of concrete units being formed. Plungers typically include a rigid material such as steel and are welded on one end to the head structure and on the other end to the stripper shoe. The plungers provide the structural load path to compress the concrete and strip the formed concrete product from the mold.

Upon filling the mold with concrete, the tamperhead is lowered until the stripper shoes enter the mold cavities and contact the concrete. To accomplish this, the stripper shoes and the mold cavities must be particularly aligned. This alignment process may inflict significant wear and stress on both the mold and tamperhead, resulting in increased production time and cost.

By design, a stripper shoe mounted on a tamperhead needs to fit a respective mold cavity with a minimal clearance. Depending on the type and size of product being manufactured, the amount of necessary clearance may vary. However, if the clearance is too small, the shoe will abrade against the cavity wall, thereby inducing stress in the mold and production machinery as well as premature wear on the machinery. On the other hand, if the clearance is too large, concrete will extrude between the shoe and the cavity walls, forming "burrs" on top of the product which, at best, detract from its aesthetic appeal and, at worst, create installation problems in the field.

Additionally, the demands and economics of the concrete product production industry result in the need to run the production machinery at high speeds to produce a large amount of product. As a consequence, a stripper shoe may impact the leading edge of a mold cavity repeatedly at high impact forces. The impact of the stripper shoe on the leading edge varies from one machine to another because different production machines use different systems to drive a compression beam. For example, some production machines use a hydraulic system, while others use a mechanical system. Additionally, the machines may operate at varying speeds and vibration frequencies as the specific type of concrete products being produced may require. Nevertheless, these impacts cause significant forces and vibrations in the mold cavities and in the tamperhead. These impact forces and vibrations are considered a significant factor in the failure of tamperheads and, more particularly, in the failure of plungers. Furthermore, severe impacts between the stripper shoes and the mold may cause significant damage to the mold and, in some cases, may result in catastrophic failure of the mold by crushing the thin walls separating the individual mold cavities.

While the tamperhead and the mold cavities are normally aligned when the production machinery is assembled, this alignment still does not prevent stresses on the tamperhead once the machinery begins to be used in the production of concrete products. The production process includes vibrating or shaking of the mold assembly with a vibration system every eight to fifteen seconds as the concrete is compacted. The vibrations serve to spread the concrete material evenly within the mold assembly cavities to produce a more homogeneous concrete product and assist in compacting the concrete product. However, these vibrations also transfer forces and stresses to the tamperhead, thereby causing small variations in the position of the production machinery.

Unfortunately, the repeated forces transmitted by the alignment impact forces and vibrations makes the plunger and joints in the tamperhead susceptible to material fatigue failure and cause wear and stress on the mold. As a result of the combined stresses and wear, expensive plungers typically last for only a short period of time and must be replaced at great expense and loss of valuable production time. Likewise, damaged mold cavities must be replaced or repaired, requiring significant and costly machining.

Furthermore, as the vibrator system shakes the mold assembly, the rest of the machine also experiences vibrations as forces are transmitted through the plungers. These vibrations cause the system to resonate if the frequency of the vibrator system approaches or falls on a natural frequency of the machinery. This resonance may fatigue the tamperhead, and particularly the plungers. As the components degrade, surface quality and product density of the finished product is also altered. Thus, the vibrations and alignment impacts reduce machine operating life and also reduce product quality and increase the frequency of replacement of parts.

A traditional approach for avoiding frequent failure and replacement of the plungers is to shorten the plunger length and increase the plunger strength and/or stiffness. However, this approach has not been successful at extending the useful life of the plungers. Time has shown that short, stiff plungers frequently fail, with the joint between the plunger and the head structure being especially vulnerable. Further, stiffer plungers increase wear on the stripper shoes and mold assemblies during alignment impacts and actually exacerbate the need to replace or repair expensive components.

Another traditional approach for avoiding frequent failure and replacement of the plungers is to increase the weight of the plungers. However, these plungers also increase production costs. As the weight of plungers increases, the expense of fabricating the plungers also increases due to the use of more expensive materials. Additionally, a plunger with greater weight functions to increase the power and expense required to run the production machinery. The increased weight also intensifies the deterioration of moving parts under heavy load and increased impact forces between stripper shoes and mold assemblies.

Therefore, there exists a need for a tamperhead which is less susceptible to failure due to vibration and fatigue stresses and which reduces impact loads between the mold cavities and stripper shoes during alignment.

SUMMARY OF THE INVENTION

The invention generally relates to concrete-based product making machinery. More particularly, the invention relates to a composite tamperhead for use in machinery for producing molded concrete-based products.

In one embodiment of the present invention, a tamperhead structure for use in a machine for producing molded products may include a first plate, a second plate, at least one spacer attached to the first plate and to the second plate and a plurality of non-metal plungers attached to the second plate, each of the plurality of plungers having a stripper shoe. Further, the plurality of non-metal plungers may be configured to absorb machine vibrations and forces during the production of molded products.

In another embodiment of the present invention, a tamperhead structure for use in a machine for producing molded products may include a first plate, a second plate, at least one spacer attached to the first plate and to the second plate and a plurality of non-metal plungers attached to the second plate, each of the plurality of plungers having a stripper shoe. Further, the structure may include an isogrid structure connecting the first plate and the second plate. The isogrid structure may be configured to absorb machine vibrations and forces during the production of molded products.

The tamperhead structure of the present invention creates a more flexible and resilient structure than prior art steel tamperhead structures. First, the tamperhead is not manufactured from a single material. Due to the mechanical properties of the components of the tamperhead, the different components may not combine to form a destructive resonant frequency. Without a destructive resonant frequency, different tamperheads may be employed in different production machines with little concern for the vibration frequencies of the production machinery.

Additionally, construction of the tamperhead structure of the present invention may be simpler and less costly than the traditional tamperhead structures. Non-metal components may be chemically bonded to metal components, avoiding the adverse effects of welding induced stresses. Additionally, plastic parts may be molded with high precision and in large quantities, significantly reducing the cost of machining metal components within tight tolerances. Further, the stresses and warping that accompanies welding are eliminated where adhesive is used to assemble different components of the tamperhead because there is no need to heat the components.

Furthermore, the use of non-metal material for the plungers may result in significantly more flexibility than traditional steel plungers. The added flexibility of the plungers may reduce the transmission of destructive vibrations from the stripper shoes to the upper head structure. The flexibility may also reduce impact forces experienced by the stripper shoes and the entire tamperhead structure during alignment. The reduction of vibration transmission and the reduction of impact forces work to prolong the usable life of the tamperhead structure and reduce the production cost and machinery repair time.

Finally, the tamperhead structure of the present invention may weigh less than traditional structures and requires less effort and expense to operate. With the composite tamperhead structure of the present invention, less vibration force may be required to compact the concrete in the molds because the entire production assembly will be lighter and, therefore, easier to vibrate. Also, due to the lighter weight of the tamperhead structure, the production machinery may operate on less power and an operator may experience greater control over the machinery.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference to the Figures in which various embodiments of the present invention are shown. The subject matter of this disclosure may, however, be embodied in many different forms and should not be construed as being limited to the embodiments set forth herein.

Figure 1:
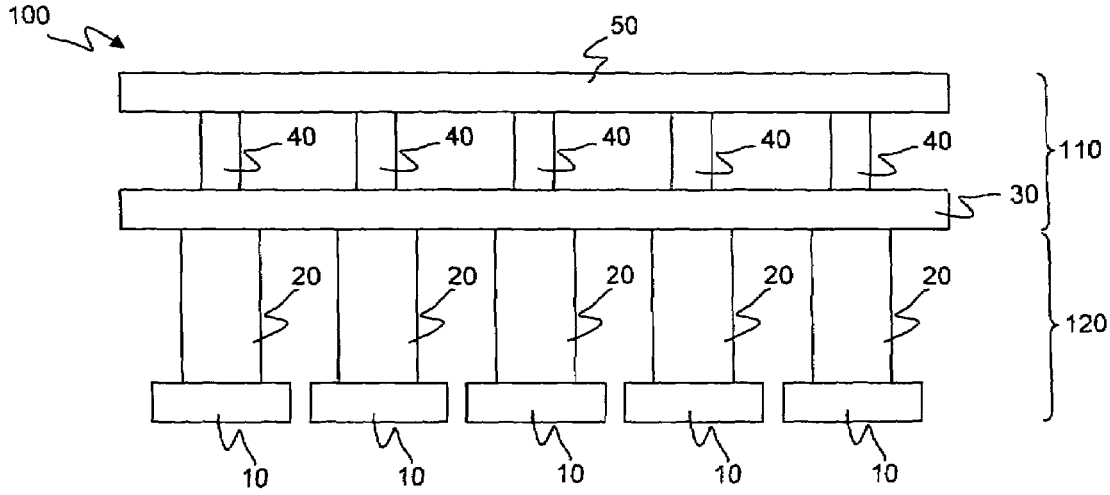
FIG. 1 shows a front view of a tamperhead structure according to one embodiment of the present invention.

FIG. 1 shows a front view of a tamperhead structure 100 according to one embodiment of the present invention. The tamperhead structure 100 may include an upper head structure 110 and a lower head structure 120. The lower head structure may include one or more stripper shoes 10 attached to one or more plungers 20. The upper head structure 110 may include a lower plate 30 and an upper plate 50 connected by one or more spacers 40. The shape and thickness of the upper plate 50 and the lower plate 30, and the overall shape and size of the tamperhead structure 100, may vary depending on the production machinery with which it is to be used. While a rectangular shape is illustrated in the figures, it should be realized that any shape and size are contemplated.

As will be readily apparent to one of skill in the art, any number of plungers 20 and stripper shoes 10 arranged in any pattern may be incorporated into the tamperhead structure so as to match the mold cavity (not shown) with which the tamperhead structure is to be used. In one embodiment of the present invention, the plungers 20 and stripper shoes 10 may be fabricated from any non-metal material or combination of non-metal materials including, but not limited to, polymers, impreganated polymers, plastic, rubber, foam, wood, carbon fiber, nylon, fiberglass, ceramics or any other material capable of withstanding the forces and stresses associated with masonry-product production. In another embodiment of the present invention, the plungers 20 may be fabricated from a non-metal material and the stripper shoes 10 may be fabricated from a metal material, such as steel or aluminum. In yet another embodiment, the stripper shoes 10 and plungers 20 may be formed integrally from a metal or non-metal material. Finally, it should be realized that the plungers may have any cross sectional shape including, but not limited to, cylindrical, rectangular, pentagonal, hexagonal or octagonal shapes.

Any number of spacers 40 may be arranged in any type of pattern between the lower plate 30 and the upper plate 50. While the spacers are shown in FIG. 1 as having a rectangular cross section, it is contemplated that any shape may be used for the spacers. Additionally, the spacers 40 and the plates 30, 50 may be fabricated from metal or non-metal materials or a combination thereof.

Figure 2:
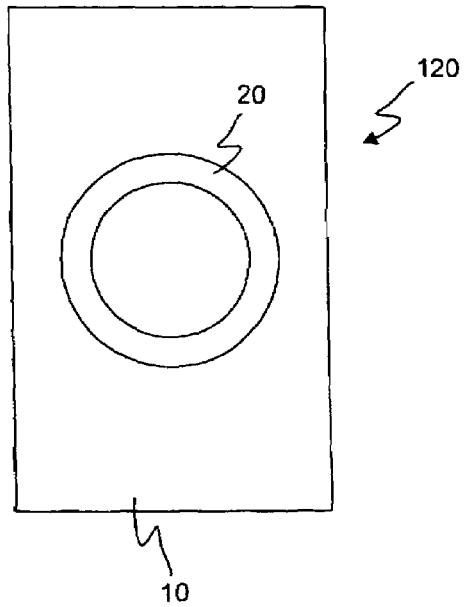
FIG. 2 shows a top view of a plunger and stripper shoe according to one embodiment of the present invention.
Figure 3:
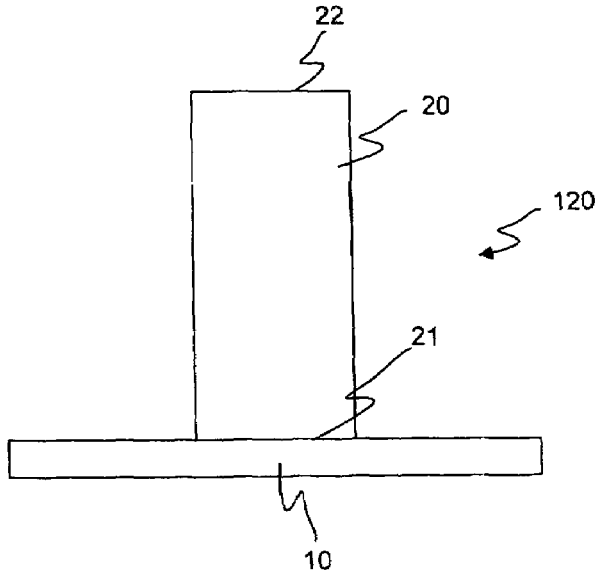
FIG. 3 shows a side view of a plunger and stripper shoe according to one embodiment of the present invention.

FIG. 2 shows a top view of a plunger and stripper shoe 10 according to one embodiment of the present invention. FIG. 3 shows a side view of a composite plunger 20 and stripper shoe 10 according to one embodiment of the present invention. In these embodiments, the plunger 20 is shown as a cylinder having a bottom surface 21 and a top surface 22. The bottom surface 21 of the plunger is attached to the stripper shoe 10 and the top surface 22 may be attached to the lower plate 30 of the upper head structure 110, as illustrated in FIG. 1. As will be readily apparent to one of skill in the art, any type of conventional attachment may be used for attaching the plunger 20 to the stripper shoe 10 and upper head structure 110. It will be obvious to one of ordinary skill in the art that the attachment used to bond the plunger 20 and the stripper shoe 10 should be capable of bonding metal and non-metal components in the event that the stripper shoe is made of metal. Where the stripper shoe is made of a non-metal material, it should be obvious to one of skill in the art that the attachment must be capable of bonding non-metal components to other non-metal components. Such bonding attachments may include, but is not limited to, the use of common adhesives such as glue or epoxy.

In an exemplary embodiment of the present invention, the construction of the upper head structure 100 includes the use of steel spacers welded between steel plates in an I-beam configuration. In this embodiment, the plungers 20 may be formed from a plastic such as acrylonitrile butadiene styrene ("ABS") or polyvinyl chloride ("PVC") and are attached to the lower plate 30 using a common adhesive. The stripper shoes 10 are formed of steel and are also attached to the plungers 20 using a common adhesive.

It has been found that the use of at least some non-metal components in the tamperhead structure results in a lighter overall weight of the tamperhead structure without sacrificing the functionality seen by tamperheads constructed only from metal. This, in turn, results in reduced wear and tear on production machinery and increased ease of control over the tamperhead during production. For example, in the exemplary embodiment discussed above, the use of plastic plungers 20 enables the thickness of the steel lower plate 30 and upper plate 50 to be reduced by up to ⅛ inch from traditional (steel plunger) tamperheads because less weight must be supported by the plates. This, in turn, may result in a reduction in the overall weight of the tamperhead of 300 lbs or more, depending on the size of the structure.

Additionally, the use of non-metal components in the tamperhead structure results in better absorption of vibrations and stresses inherent in the production process, resulting in delayed development of material fatigue when compared to traditional plungers. Further, the likelihood of a resonant frequency developing, as discussed above, is significantly decreased because of the differences in the resonant frequency between the metal and non-metal components. The plungers 20 are also less susceptible to wear and tear because of the increased flexibility and absorption characteristics of non-metal materials. As such, the life of the machinery, and especially the plungers 20, may be increased.

Finally, the use of non-metal plungers enables easy replacement in the event the plungers fail. Because the plungers may be attached using an adhesive or similar substance, there is no welding or similar attachments which must be undone before the failed plungers may be removed. This results in decreased periods during which the machinery is inoperable. Further, this results in a reduction in the amount of time and skill required to assemble or repair the tamperhead.

Figure 4:
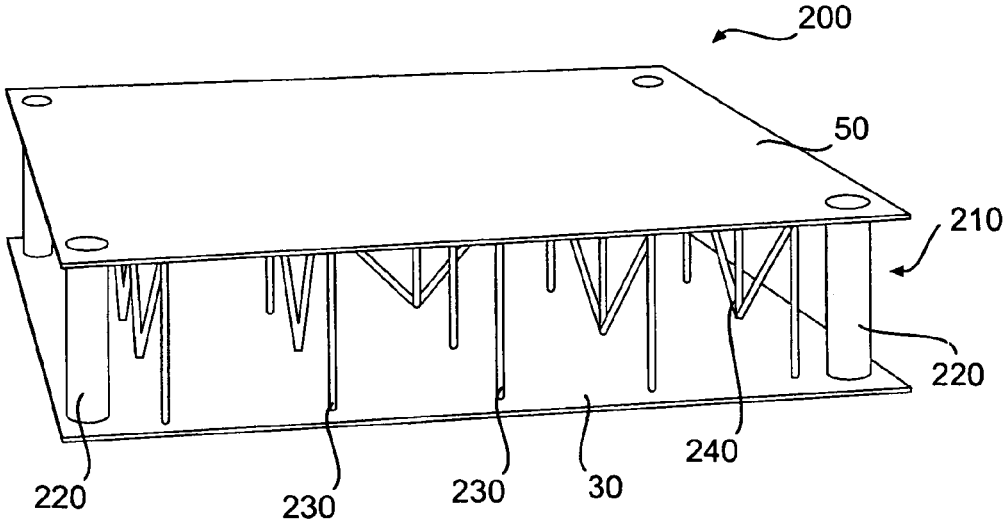
FIG. 4 shows a perspective view of the upper head structure of a tamperhead structure according to one embodiment of the present invention.
Figure 5:
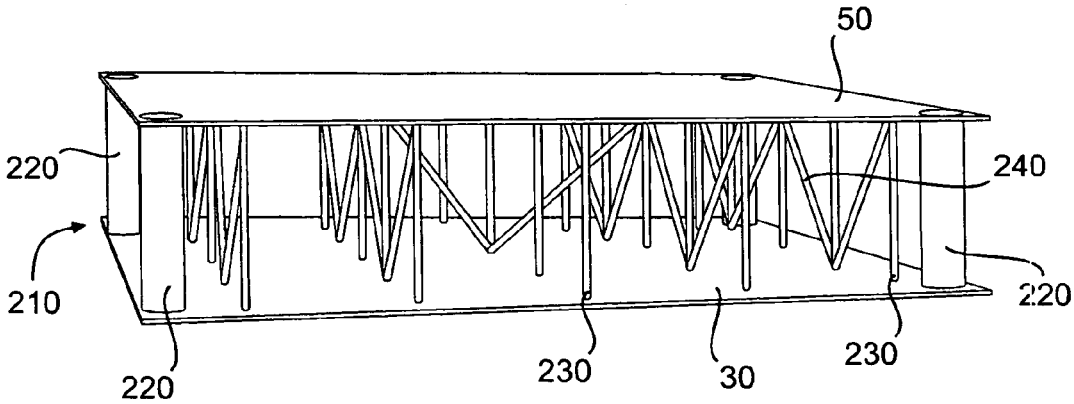
FIG. 5 shows another perspective view of the upper head structure of the tamperhead structure according to one embodiment of the present invention.
Figure 6:
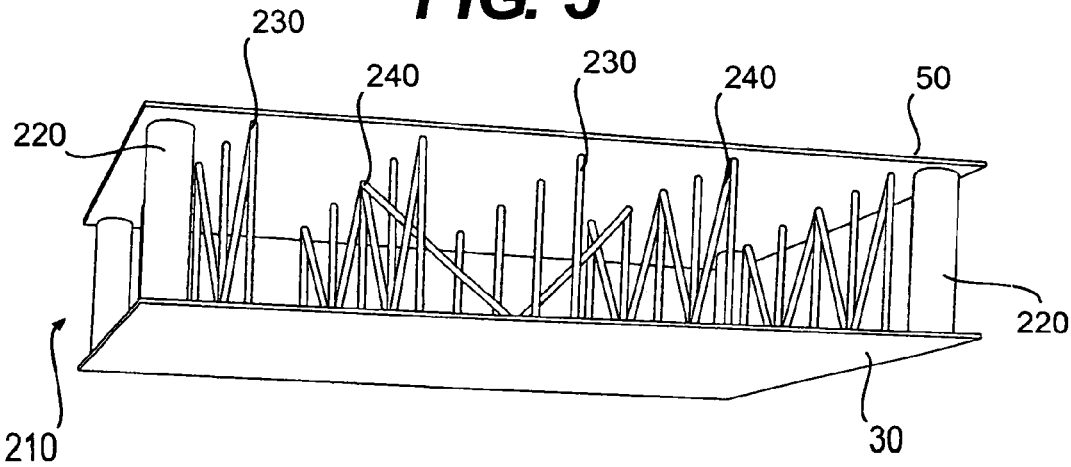
FIG. 6 shows yet another perspective view of the upper head structure of the tamperhead structure according to one embodiment of the present invention.

FIGS. 4, 5 and 6 show perspective views of the upper head structure of a tamperhead structure according to one embodiment of the present invention. As illustrated in FIGS. 4-6, the upper head structure 200 may include a lower plate 30 and an upper plate 50. In this embodiment of the present invention, an isogrid structure 210 is used as a substitute for the spacers 40 discussed above. Similar to the plungers 20 discussed above, the elements of the isogrid structure 210 may be constructed using metal or nonmetal materials, or a combination of both metal and nonmetal materials.

The isogrid structure 210 may include comer posts 220, internal posts 230 and angled posts 240. The comer posts 220 and the internal posts 230 may be oriented in a substantially vertical direction so as to provide the overall structure 200 with compressive strength and rigidity while the tamperhead is used for the compaction of concrete and the production of molded products. The angled posts 240 may be arranged at any angle and serve to provide torsional and shear stability to the overall structure 200. As will be readily apparent to one of skill in the art, the posts 220, 230 and 240 may have any cross sectional shape, similar to the spacers 40 discussed above. Further, the posts 220, 230 and 240 may be arranged in any pattern or arrangement between the lower plate 30 and the upper plate 50 as long as the overall functionality of the upper head structure is retained.

In one embodiment, the posts 220, 230 and 240 may be fabricated from non-metal materials and may be adhesively attached at either end to the lower plate 30 and the upper plate 50, according to methods well known to those of skill in the art. The plates 30, 50 may be fabricated from steel or other metals so as to provide sufficient stiffness and rigidity to the upper head structure 200 of the tamperhead.

The use of an isogrid 210 between the lower plate 30 and the upper plate 50 has been found to increase the overall flexibility and shear strength of the tamperhead during production of molded products. For example, in the event that the stripper shoes are not properly aligned with the mold cavities, the isogrid 210 may allow the tamperhead to move into alignment while absorbing the forces associated with aligning the tamperhead and the mold. As such, the useful life of the tamperhead may be extended when compared to traditional tamperhead structures.

Figure 7:
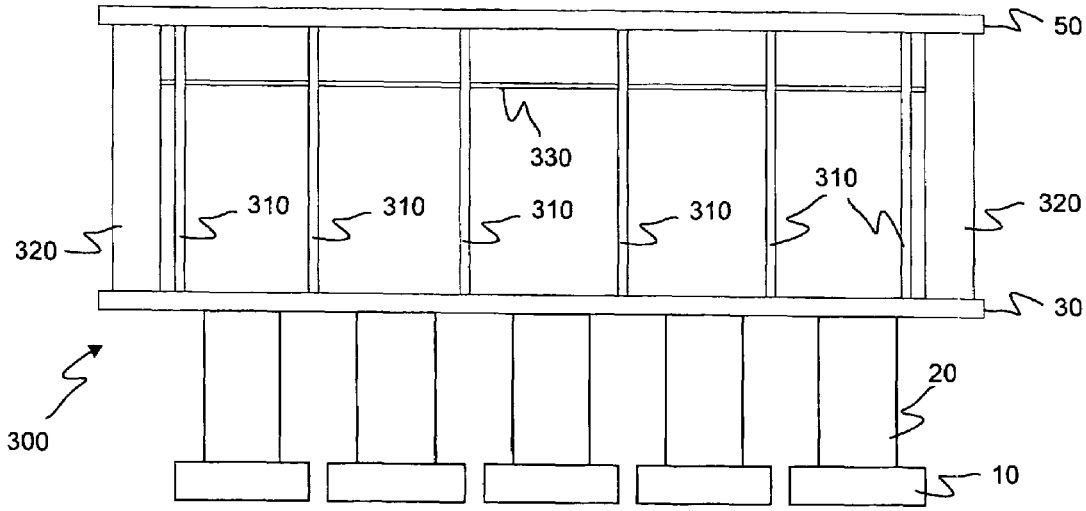
FIG. 7 shows a front view of a tamperhead structure according to another embodiment of the present invention.
Figure 8:
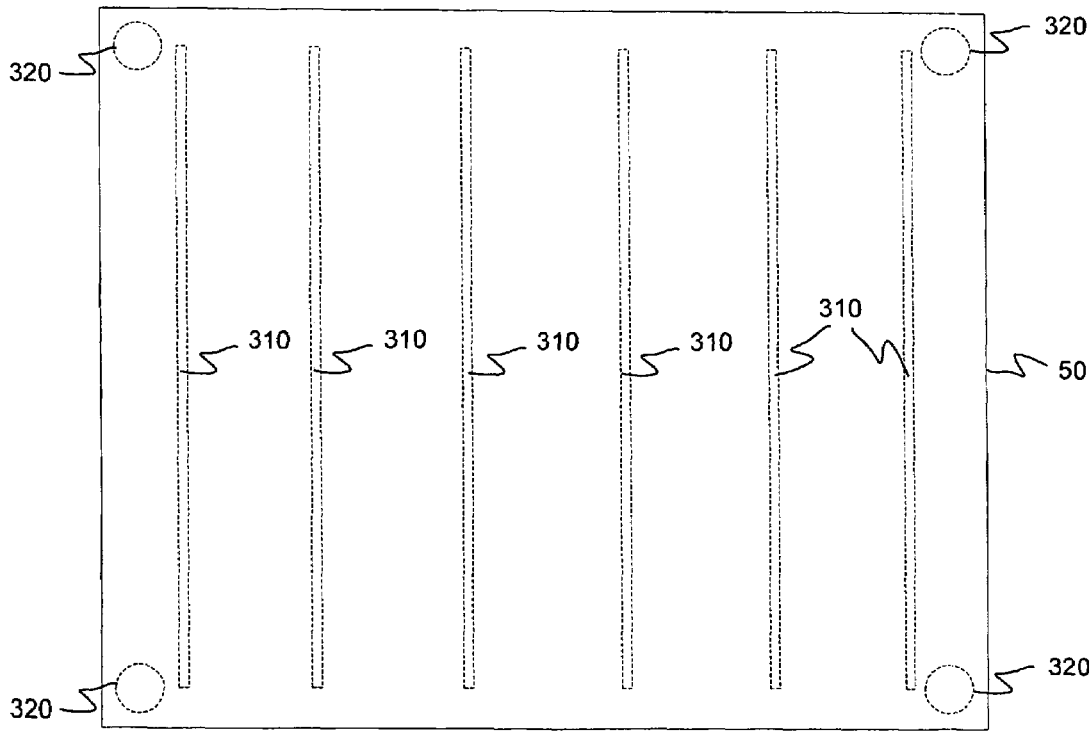
FIG. 8 shows a top view of a tamperhead structure according to another embodiment of the present invention.

FIGS. 7 and 8 show different views of a tamperhead structure according to yet another embodiment of the present invention. As illustrated in FIG. 7, the upper head structure 300 may include a lower plate 30 and an upper plate 50 separated by support plates 310 and corner posts 320. In FIG. 8, the support plates 310 and corner posts 320 are shown as dashed lines beneath the upper plate 30. In this embodiment of the present invention, the support plates 310 and the corner posts 320 may be fabricated from any metal or non-metal material or any combination of metal and nonmetal material, similar to the spacers 40 discussed above.

The support plates 310 and the corner posts 320 may be attached to the lower plate 30 and the upper plate 50 using any means for attaching known in the art and as discussed above with reference to FIGS. 1-6. The support plates 310 and the corner posts 320 may also be attached using any means for attaching known to one of skill in the art and as discussed above. Although not necessary, one embodiment of the present invention includes a cross plate, or stabilizing plate, 330 which may be employed to provide additional overall stiffness and stability to the tamperhead structure.

One of ordinary skill in the art will recognize how the composite structure of the different embodiments of the present invention avoids natural frequencies and resonant modes by incorporating different materials into the construction of the tamperhead. It should be understood that composite plungers may be combined with other traditional or composite tamperheads without deviating from the scope and spirit of the present invention. Furthermore, the composite tamperhead of the present invention may be used with other traditional or composite plungers without deviating from the scope and spirit of the present invention.

The foregoing descriptions of specific embodiments of the present invention are presented for purposes of illustration and description. They are not intended to be exhaustive or to limit the invention to the precise forms disclosed. Obviously, many modifications and variations are possible in view of the above teachings. While the embodiments were chosen and described in order to best explain the principles of the invention and its practical applications, thereby enabling others skilled in the art to best utilize the invention, various embodiments with various modifications as are suited to the particular use are also possible. The scope of the invention is to be defined only by the claims appended hereto, and by their equivalents.

What is claimed is:

1. A tamperhead structure for use in a machine for producing molded products, the structure comprising:

a first plate;

a second plate;

at least one spacer attached to said first plate and to said second plate; and a plurality of non-metal plungers attached to the second plate, each of said plurality of plungers having a stripper shoe;

wherein said plurality of non-metal plungers are configured to absorb machine vibrations and forces during the production of molded products.

2. The structure of claim 1, wherein said at least one spacer is fabricated from a non-metal material.

3. The structure of claim 1, wherein said plurality of non-metal plungers are fabricated from one of ABS and PVC.

4. The structure of claim 1, wherein each of said plurality of plungers are adhesively attached to said second plate.

5. The structure of claim 4, wherein said plurality of plungers are attached to said second plate using one of glue and epoxy.

6. The structure of claim 1, wherein said at least one spacer, said first plate and said second plate are all fabricated at least partially from a non-metal material.

7. The structure of claim 1, wherein each stripper shoe is adhesively attached to its respective plunger.

8. The structure of claim 1, wherein said plurality of non-metal plungers are configured for easy replacement.

9. A tamperhead structure for use in a machine for producing molded products, the structure comprising:

a first plate;

a second plate;

a plurality of non-metal plungers attached to the second plate, each of said plurality of plungers having a stripper shoe; and an isogrid structure connecting said first plate and said second plate and being configured to absorb machine vibrations and forces during the production of molded products.

10. The structure of claim 9, wherein said isogrid structure is fabricated at least partially from a non-metal material.

11. The structure of claim 9, wherein said isogrid structure comprises at least one vertical support attached to said first plate and said second plate and at least one angled support attached to said first plate and said second plate.

12. The structure of claim 9, wherein said isogrid structure is adhesively attached to said first plate and said second plate.

13. The structure of claim 12, wherein said isogrid structure is attached to said first plate and said second plate using one of glue and epoxy.

14. The structure of claim 9, wherein said plurality of non-metal plungers are configured for easy replacement.

* * * * *